US007788741B2

(12) United States Patent
Lohss

(10) Patent No.: US 7,788,741 B2
(45) Date of Patent: Sep. 7, 2010

(54) AUTOMATIC TOILET LID AND SEAT

(76) Inventor: Kurt L. Lohss, 795 E. Lake St., Pentwater, MI (US) 49449

( * ) Notice: Subject to any disclaimer, the term of this patent is extended or adjusted under 35 U.S.C. 154(b) by 1239 days.

(21) Appl. No.: 11/357,528

(22) Filed: Feb. 17, 2006

(65) Prior Publication Data

US 2006/0242755 A1 Nov. 2, 2006

Related U.S. Application Data

(60) Provisional application No. 60/675,553, filed on Apr. 28, 2005, provisional application No. 60/765,103, filed on Feb. 4, 2006.

(51) Int. Cl.
*A47K 13/10* (2006.01)

(52) U.S. Cl. ..... 4/246.1; 4/236; 4/248

(58) Field of Classification Search ..... 4/234, 4/236, 240, 241, 246.1–246.5, 248
See application file for complete search history.

(56) References Cited

U.S. PATENT DOCUMENTS

| | | | | |
|---|---|---|---|---|
| 2,772,422 | A | | 12/1956 | Knudsen |
| 2,814,049 | A | | 11/1957 | Mecur |
| 3,284,810 | A | | 11/1966 | Stokes |
| 3,316,561 | A | | 5/1967 | Newkirk |
| 3,404,411 | A | | 10/1968 | Newkirk |
| 4,055,864 | A | | 11/1977 | Liu et al. |
| 4,141,090 | A | | 2/1979 | Rowan |
| 4,338,690 | A | | 7/1982 | Hsieh et al. |
| 4,392,260 | A | | 7/1983 | Bensen |
| 4,962,551 | A | * | 10/1990 | Bly ..... 4/236 |
| 4,995,120 | A | | 2/1991 | Tager |
| 5,003,643 | A | | 4/1991 | Chung |
| 5,307,524 | A | | 5/1994 | Veal |
| D352,100 | S | | 11/1994 | Veal |
| D352,101 | S | | 11/1994 | Veal |
| 5,546,612 | A | * | 8/1996 | Johnson ..... 4/248 |
| 5,603,127 | A | | 2/1997 | Veal |
| D380,817 | S | | 7/1997 | Veal |
| D382,948 | S | | 8/1997 | Veal |
| D393,627 | S | | 4/1998 | Veal |
| 5,878,444 | A | * | 3/1999 | Convoy ..... 4/246.1 |
| 6,067,667 | A | * | 5/2000 | Suzuki ..... 4/246.1 |
| 6,618,864 | B2 | | 9/2003 | Veal |
| 6,643,852 | B1 | | 11/2003 | Lin |
| 2002/0029412 | A1 | | 3/2002 | Veal |

* cited by examiner

*Primary Examiner*—Tuan N Nguyen
(74) *Attorney, Agent, or Firm*—Warner Norcross & Judd LLP

(57) ABSTRACT

A touch free, automatic seat and lid actuating system for toilets includes at least one of an advantageous drive mechanism for raising and lowering the seat and lid, a clutch mechanism enabling manual operation of the seat and the lid, and an attachment system for removably attaching the seat and the lid. The drive mechanism includes a first drive for operating the seat and a second drive for operating the lid. The clutch mechanism includes a pin interfitting into a notch, and biased into the notch with a spring. The attachment mechanism allows the seat and/or lid to be locked on the toilet in a lowered position, and readily removable from the toilet in a raised position.

8 Claims, 9 Drawing Sheets

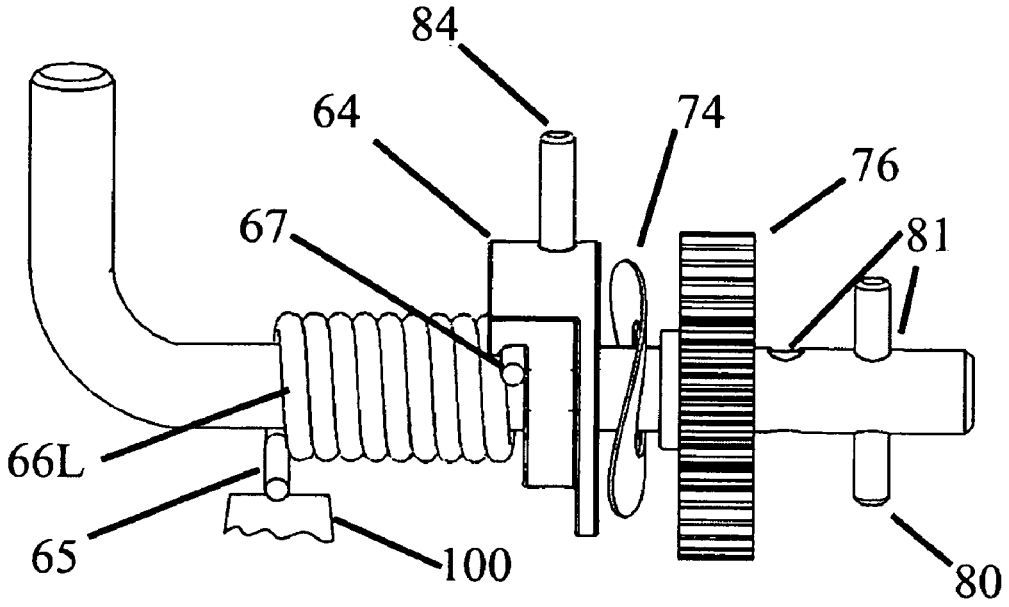
FIG 6 A -CLUTCH EXPLODED VIEW
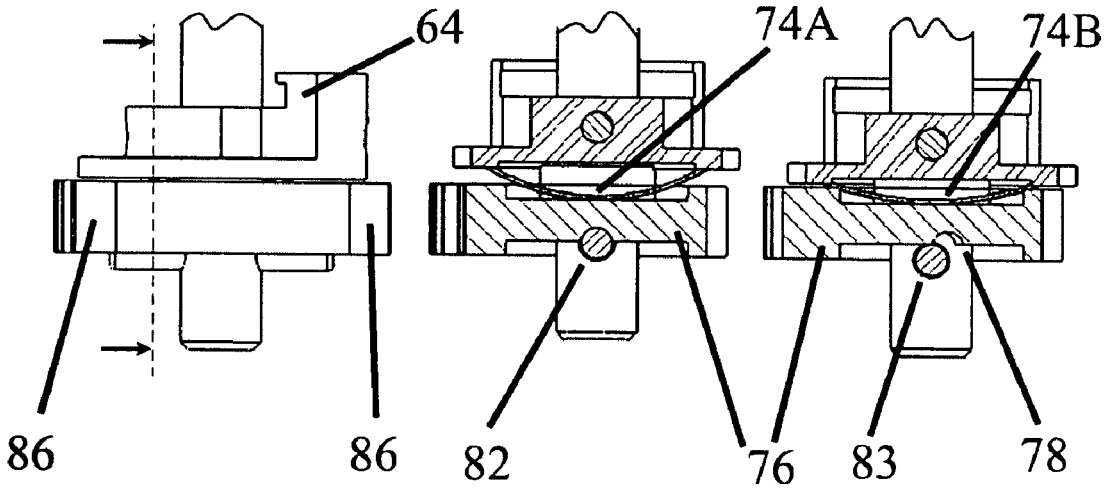
FIG 6 B - CLUTCH ENGAGEMENT

AUTOMATIC TOILET LID AND SEAT

This application claims the benefit of U.S. Provisional Application No. 60/675,553, which was filed on Apr. 28, 2005 and entitled "Automatic Lid and Seat Actuation and Flushing Arrangement for Toilets" and U.S. Provisional Application No. 60/765,103, which was filed on Feb. 4, 2006, and entitled "Automatic Lid and Seat Actuation and Flushing Arrangement for Toilets."

BACKGROUND OF THE INVENTION

The present invention relates generally to touch free, automatically activated seat and lid raising and lowering arrangements for toilets. Particularly this invention relates to a complete, low-cost touchless operation of a toilet mechanization system that can be incorporated as original equipment or retrofitted into existing toilets.

Minimum contact with the commode is desirable from a personal hygiene standpoint, for health reasons both real and psychological, as well as simplified maintenance. A number of attempts have been made at developing automatically activated seat raising and lowering arrangements including, for example, the arrangements shown and illustrated in U.S. Pat. Nos. 6,643,852, 6,618,864, 5,603,127 and 5,307,524. Unfortunately, however, none of these arrangements have the aesthetic appeal, simplicity, robustness, power saving capability and ergonomic features necessary to make a commercially marketable product.

SUMMARY OF THE INVENTION

The aforementioned problems are overcome by the present invention, wherein a touch free, automatic seat and lid actuating system for toilets includes at least one of an advantageous drive mechanism for raising and lowering the seat and lid, a clutch mechanism enabling manual operation of the seat and the lid, and an attachment system for removably attaching the seat and the lid.

In one embodiment, the assembly includes a first drive operably connected to the seat that is capable of being actuated to raise and lower the seat, and a second drive operably connected to the lid that is capable of being actuated to raise and lower the lid. The first and second drives and at least a portion of the first and second output shafts may be encapsulated within a water resistant housing that is fastened to the porcelain toilet using existing seat hole locations.

In another embodiment, the assembly includes a motor, an output shaft connected to one of the seat and the lid and capable of being actuated to raise and lower the seat or the lid, and a clutch connecting the motor to the output shaft. The clutch includes a first element that defines a notch, a second element interfitting with the notch, and a spring biasing the second element into the notch. The second element is capable of being forced out of the notch to disengage the motor from the output shaft when the seat or the lid are manually raised or lowered. In a more specific embodiment, the assembly includes a second motor, a second output shaft and a second clutch similar to the first clutch, such that both the seat and the lid can be either automatically or manually operated.

In another embodiment, the assembly includes a drive including a first output shaft, a housing mounted to the toilet, and a seat and a lid. At least one of the seat and the lid is removably connected to the first output shaft and the housing. The selected one of the seat and the lid is movable between a lowered position and a raised position, and includes a first connector connected to the first output shaft and a second connector connected to the housing. The second connector interfits with the housing such that it is locked on the housing in the lowered position and removable from the housing in the raised position.

The drive mechanism of the present invention is advantageous over previous designs in that it is quiet and highly energy efficient. In addition, it can be housed entirely within an aesthetically pleasing, water resistant housing. The clutch mechanism enables the system to be robust, and easily operated either automatically or manually. The attachment system provides for easy removal of the seat and lid for maintenance or cleaning purposes.

These and other objects, advantages, and features of the invention will be readily understood and appreciated by reference to the detailed description of the current embodiments and the drawings.

BRIEF DESCRIPTION OF THE DRAWINGS

FIG. 6A is an exploded view of the clutch components.

FIG. 6B shows a top view of the clutch and two cross-sectional views thereof along line 6-6.

DETAILED DESCRIPTION OF THE CURRENT EMBODIMENT

I. Overview

Figure 1:
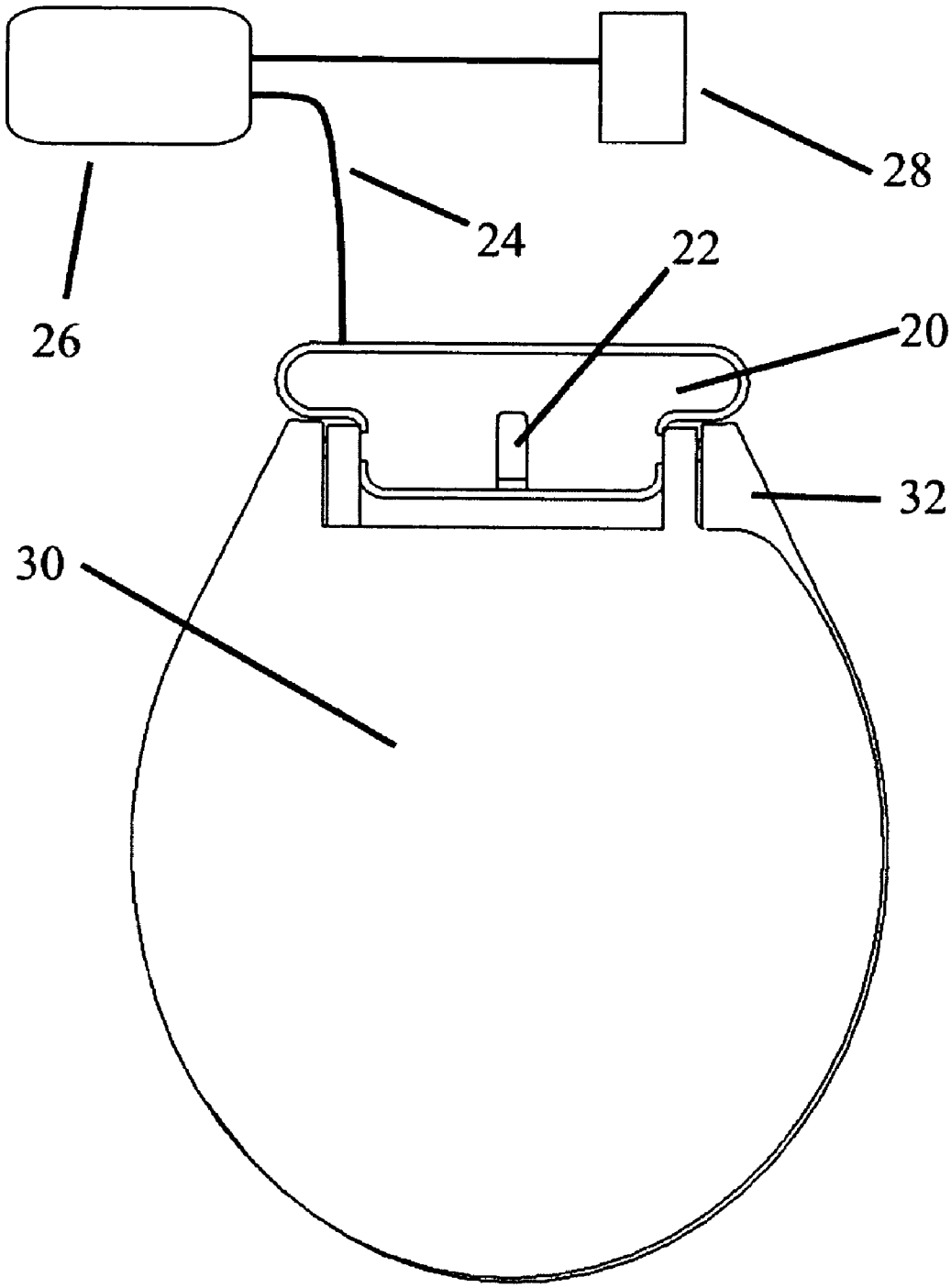
FIG. 1 is a top view of the present invention according to one embodiment.

One embodiment of the present invention is shown generally in FIG. 1. As illustrated, this embodiment includes a housing assembly 20 containing a waterproof actuator that has two independent motorized actuators or drives, sensing and motor control circuitry, a sensor window 22, an actuator wire 24, a battery 26, and an optional flush motor with wire 28. In this embodiment, one actuator raises and lowers the lid 30 and the other actuates the seat 32.

II. Structure

Figure 2:
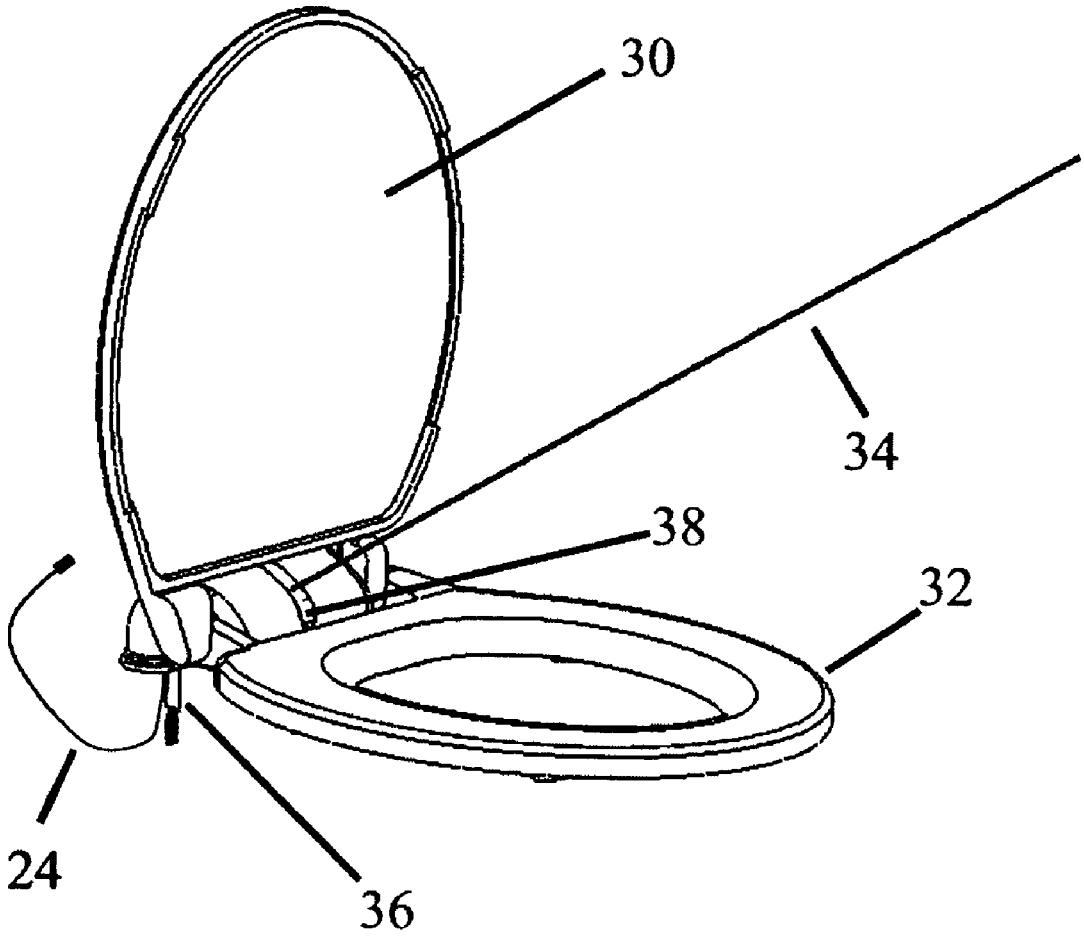
FIG. 2 is an oblique view thereof showing the lid in a raised position.

FIG. 2 illustrates an embodiment of the present invention, wherein the invention includes a housing 20 and a sensor element 38. The housing 20 is mounted to the existing seat holes on the porcelain toilet bowl (not shown) with bolts 36. A cable 24 extends from the housing for connection to the battery 26 or another power supply, such as a wall outlet. The sensor assembly 38 may be used to signal the control circuitry 48 to actuate one or both of the actuators. A variety of conventional sensor elements 46 may be used in the sensor assembly 38 for sensing distance, such as an ultrasonic sensor, an optical sensor or an infrared sensor. As illustrated, the sensor assembly 38 is positioned in the housing 20 behind the sensor window 22, such that the beam trajectory 34 has an unobstructed view with lid 30 or seat 32 in the up or down position. As shown, the distance sensor assembly 38 is pointing at approximately a 45-degree angle from the floor. The sensor axis is pointed upward and aimed to detect the presence of a person's torso standing in front of the toilet for activation of the lid 30, and also for detecting a closer hand swipe or other signal for seat 32 activation. The location and angle of the sensor allow an unobstructed view of the torso and hand with lid 30 and seat 32 fully in the fully up or down position.

Figure 3:
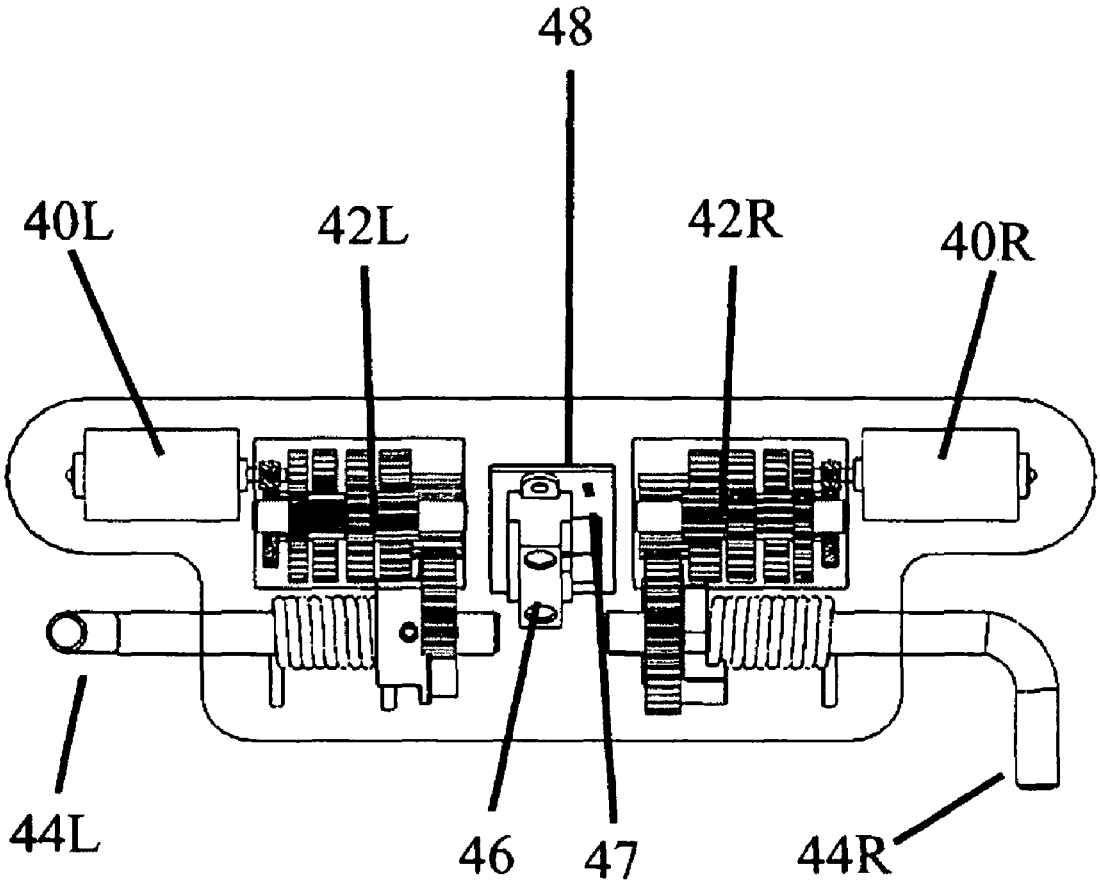
FIG. 3 is a top view of the internal construction of the housing.

FIG. 3 shows the internal construction within the housing 20. As illustrated, the internal construction includes two independent reversible motors 40R and 40L, gear reductions 42R and 42L connected to each motor, a lid output shaft 44L shown in open position, and a seat output shaft 44R shown closed. Also shown is the location of the sensor element 46, a sensor control circuit 48 and an LED indicator 47.

Figure 4A:
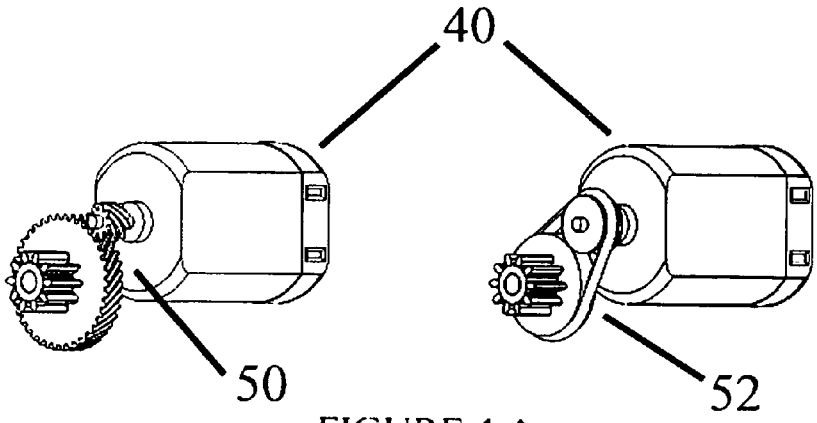
FIG. 4A is a perspective view of two alternate motor drive configurations.

FIG. 4A illustrates two alternative embodiments for a motor drive arrangement. In one embodiment, a highly efficient helical motor gear drive 50 is used. In the other embodiment, a less efficient, but quieter belt drive 52 configuration is used. The belt 52 is illustrated with a square profile, however, a cogged timing belt is also suitable.

Figure 4B:
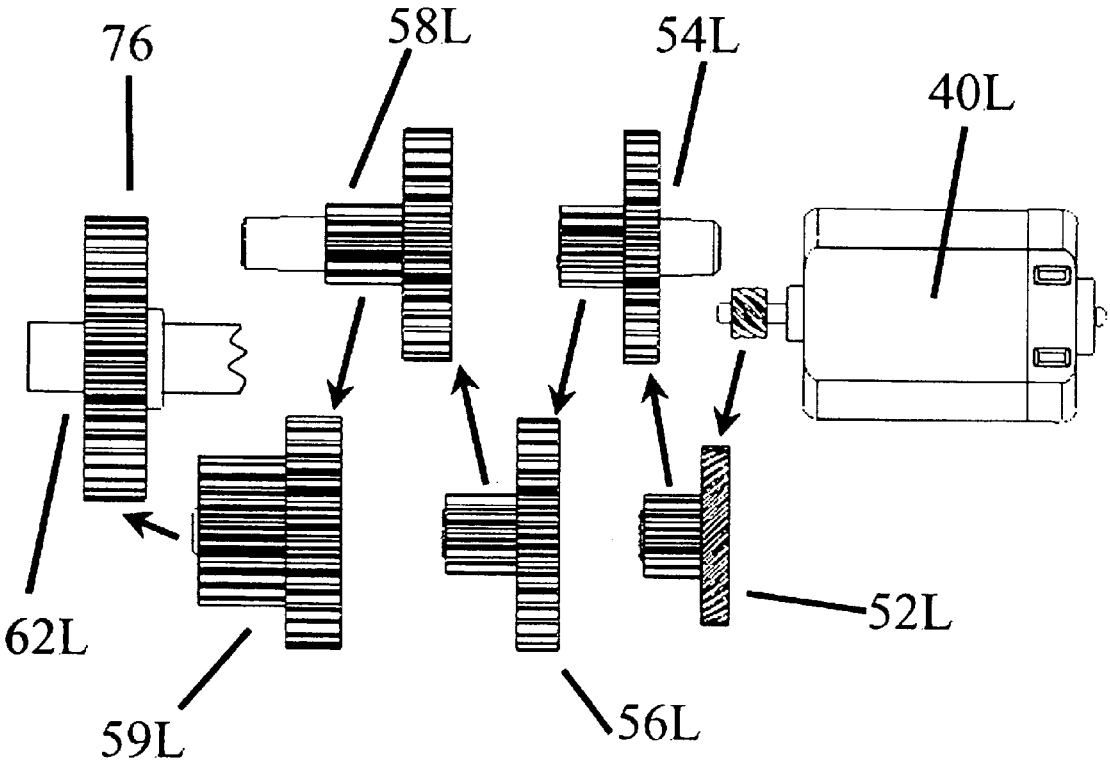
FIG. 4B is an exploded view of a gear reduction.

FIG. 4B more specifically shows a gear reduction arrangement for operably connecting the motors 40 to their respective output shafts 44L and 44R. As shown in connection with one of the two actuators, the power flows from the motor 40L to a first stage gear 52L, a second stage gear 54L, a third stage gear 56L, a fourth stage gear 58L, a fifth stage gear 59L, a clutch final drive (or clutch gear) 76, and finally the lid output shaft 62L. In one embodiment, the overall reduction is approximately 1000:1, and offers >20% electrical to mechanical efficiency with a 2 to 4 second actuation time. The illustrated arrangement provides an efficient method for raising and lowering a seat or a lid, however, a variety of alternative gear reduction arrangements, such as a more compact planetary reduction, may be substituted for the illustrated arrangement, and different arrangements and ratios may be used for each of the two actuators, as desired.

Figure 5A:
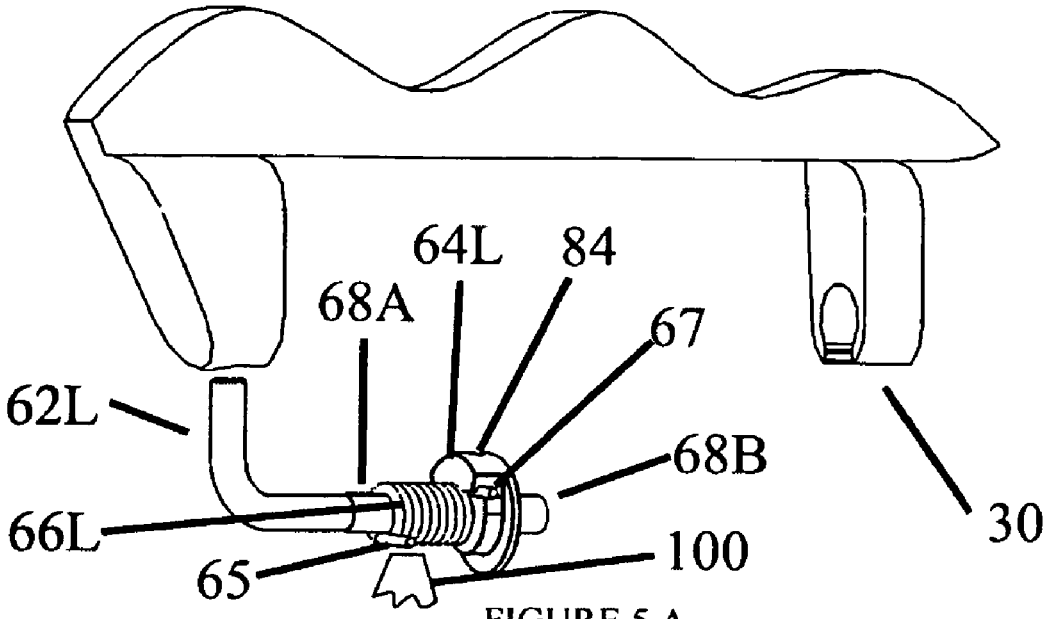
FIG. 5A is an exploded view of a portion of the seat and the output shaft assembly.

FIG. 5A illustrates one embodiment of the output shaft 62L drive to seat interface. In this embodiment, the present invention incorporates spring-elements to counterbalance the lid 30 and seat 32, such as torsion springs 66R and 66L. As illustrated, a spring perch 64L is pinned to the output shaft 62L and allows counterbalance torsion spring 66L to absorb lid or seat energy when closing. Active spring tang 67 is rigidly connected to the output shaft 62L and rotates with the shaft 62L to transmit torque through perch 64 via roll pin 84. Energy stored in the spring 66L during closing is released during opening. In the illustrated embodiment, the spring rate applies no force when the seat 32 or lid 30 is open and 100% of the torque produced by the lid 30 or seat 32 when horizontal/closed. The opposite end of the spring 66L is connected to spring tang 65. Spring tang 65 is stationary and acts against the actuator base 100, which is attached to the stationary housing at a desired location, or another stationary point on the toilet. In some cases, wherein upward forces from the spring act on rotating shaft 62L, a bushing 68A is included to extend into the spring inside diameter to minimize friction between the spring and the output shaft 62L and reduce wear. Bushing 68B may be included to tighten the tolerance for proper gear mesh. As shown, the output shaft 62L (as well as the opposite output shaft 62R) may be L-shaped, such that a portion of the output shaft may be inserted into a receptacle 63 in the rear of the seat 32.

Figure 5B:
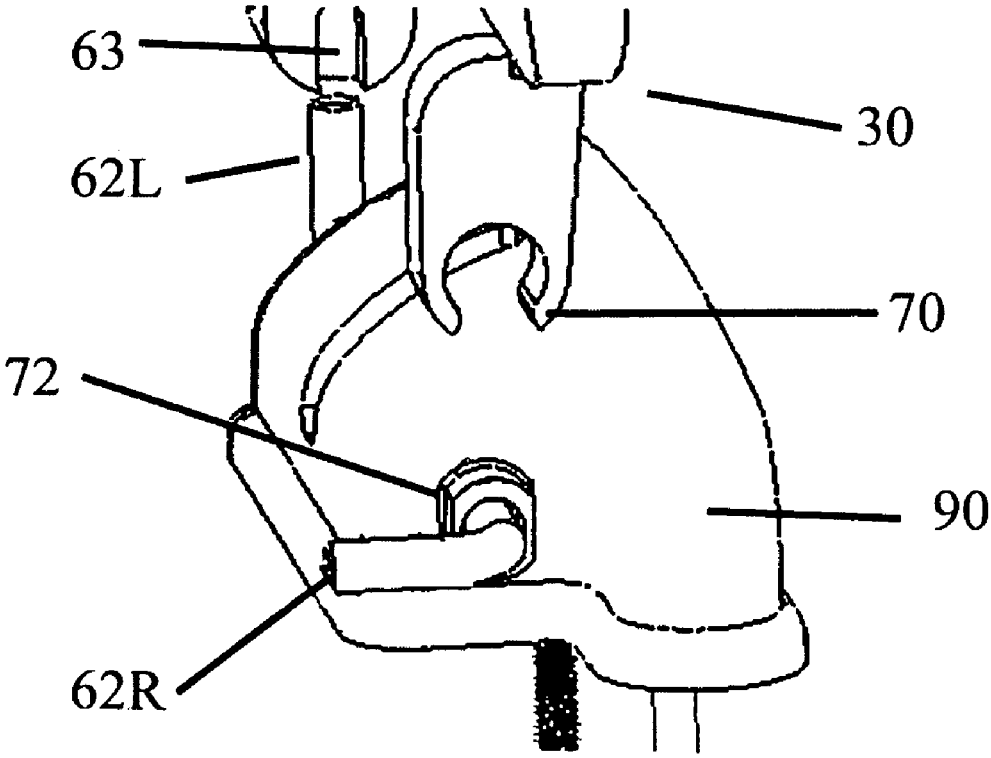
FIG. 5B is an exploded view of the attachment of the seat to the housing with the seat in a raised position.

FIG. 5B shows the vertical unlocking and horizontal locking geometry for easy removal and cleaning of the seat 32 and/or lid 30. As described above, one side of the seat 32 includes a receptacle 63 for receiving the output shaft 62L. As illustrated in FIG. 5B, the opposite side of the seat 32 includes a C-shaped slot 70. The slot 70 permits ready removal of the seat 32 when vertical but locks onto a post 72 having opposing flat sides and formed on the housing cover 90 when lid 30 and seat 32 are closed. A screw (not illustrated) on each side can create a completely captive installation with tools required for removal. Referring to FIG. 1, the lid 30 and seat 32 may each include receptacles 63 and C-shaped slots 70 on opposing sides of the lid 30 and seat 32 to accommodate the location of the output shafts 62R and 62L, which extend from opposing sides of the housing cover 90.

FIG. 6A depicts an exploded view of the clutch shaft components that may connect one or both motors 40 to one or both output shafts 62R and 62L. In the illustrated embodiment, clutch spring 74, which may be a wave washer or another spring element, forces a rounded clutch notch 78 around a smooth clutch pin 80 inserted into drilled hole 81 in the output shaft 62L. The notch 78 and clutch pin 80 are shaped such that manual rotation of the output shaft 62L (such as by manual raising or lowering of the seat 32) can force the pin 80 to rotate relative to the notch 78 and disengage from the notch 78. In the illustrated embodiment, the slot depth is less than ½ of the clutch pin diameter to allow this disengagement. Clutch gear 76, in which the notch 78 is defined, is in driving engagement with the motor 40 via gear 76. As a result, rotation of the output shaft 62L with respect to the gear 76, and the consequential disengagement of the pin 80 from the notch 78 when excessive external forces are applied to the lid 30 or seat 32 causes disengagement of the motor 40 from the output shaft 62L. Perch 64 is pinned to shaft with a roll pin 84 and provides torsional counterbalance spring 66L load and axial clutch spring 74 loads.

FIG. 6B shows an additional view of the clutch, including cross-sectional views of the clutch (along line 6-6) in both the engaged position 82, and the disengaged position 83. In the engaged position, the pin 80 is engaged in the notch 78 for driving the lid or seat by the segmented clutch gear 76. The clutch spring 74A has the necessary pre-load to bias the clutch pin 80 into slot 78. In the disengaged position 83, an overload from rapid lid 30 or seat 32 positioning by hand results overcoming the force of the spring 74A and in clutch disengagement 83. Further clutch spring travel 74B allows clutch gear 76 to slide along the shaft axis to disengage lid 30 to the motor 40 and gear reduction 42. The spur gear mesh on clutch gear 76 thus shifts axially with respect to mating fifth stage 59L during overload. When the overload force ceases, the clutch returns to the engaged position 82 automatically on the next actuation cycle. Symmetry of the clutch gear 76 and perch 64 allow error proofing and use in both right and left actuator assemblies. Stop surface 86 interfaces with features in the actuator base to provide a positive stop for the gear reduction and enables the control circuit 48 to detect an end of travel motor shut off point.

Figure 7:
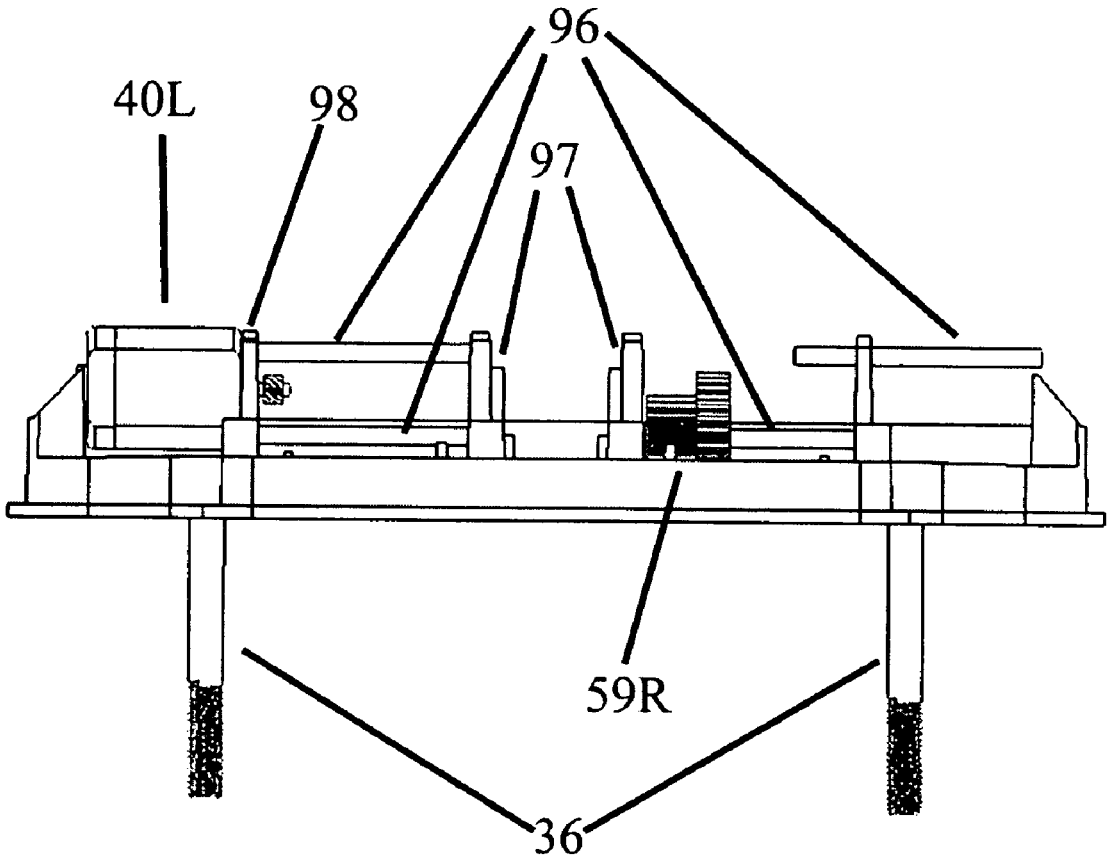
FIG. 7 shows the gear shafts and retention method.

FIG. 7 illustrates another view of the components within the housing 20. As shown, four metallic gear shafts 96, about which the various gears in the gear reductions 42R and 42L rotate, are retained by molded-in inboard stops 97 and by the motor face 98. For purposes of illustration, only motor 40L is shown in FIG. 7, and only the final stage gear 59R is shown. In the operable embodiment, all of the gears necessary for the gear reductions 42R and 42L are positioned to rotate about the gear shafts 96. It will be known to those skilled in the art that various alternative arrangements are possible for positioning and retaining the gear shafts 96.

Figure 8:
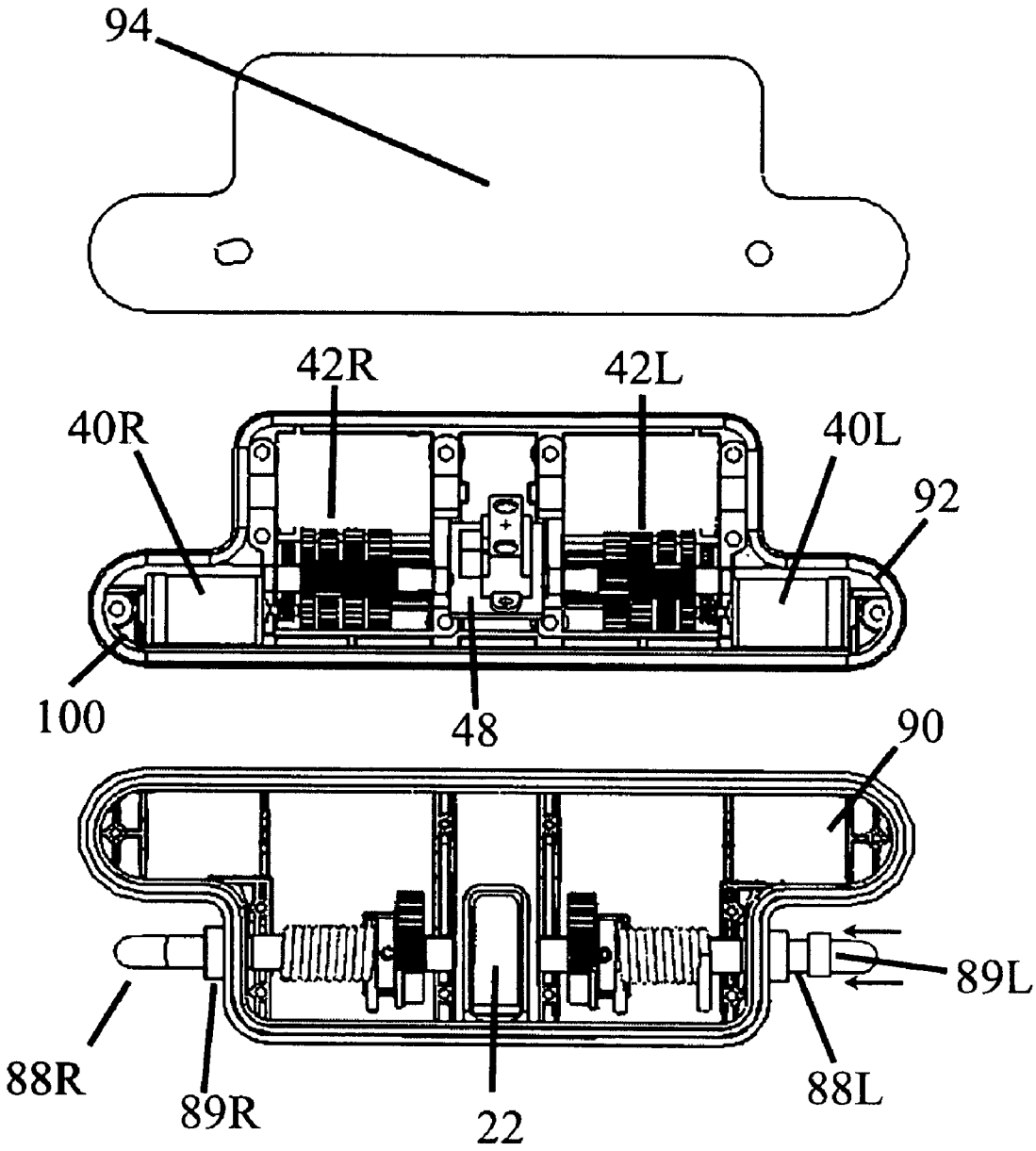
FIG. 8 illustrates a final assembly sequence of the housing and internal components.

FIG. 8 is an exploded view of one embodiment of the various components of the housing 20 and the location of the internal components at a point during assembly of the housing 20. The sensor window 22 may be assembled into the housing cover 90, followed by output shaft assemblies 88L and 88R. A housing base 100 locates the remainder of the gears 52-59 R & L and 76, motors 40L and R, sensor assembly 38, control circuit 48, and housing seal 92. Screws applied from the bottom (not illustrated) fasten the housing cover 90 and housing base 100 together to compress about the housing perimeter seal 92. Shaft seals 89R and 89L may be slid onto the respective output shafts 62R and 62L to provide a seal between the housing cover 90 and shafts 62R and 62L. The seals 89R and 89L may be slid onto the shafts 62R and 62L after the shaft assemblies 88L and 88R are installed within the cover 90. The shaft seals 89R and 89L that may be fitted within the openings that extends through posts 72 and, in this embodiment, are retained inside the cover 90. The shaft seals 89R and 89L are conventional rubber seals in the illustrated embodiment, but may be essentially any other type of seal suitable for use around a moving shaft. A base gasket 94 may be placed between the porcelain toilet and the housing base 100. The base gasket 94 is compressed with housing mounting studs 36 and forms an additional seal and compensates for any irregularities in the porcelain surface.

Figure 9:
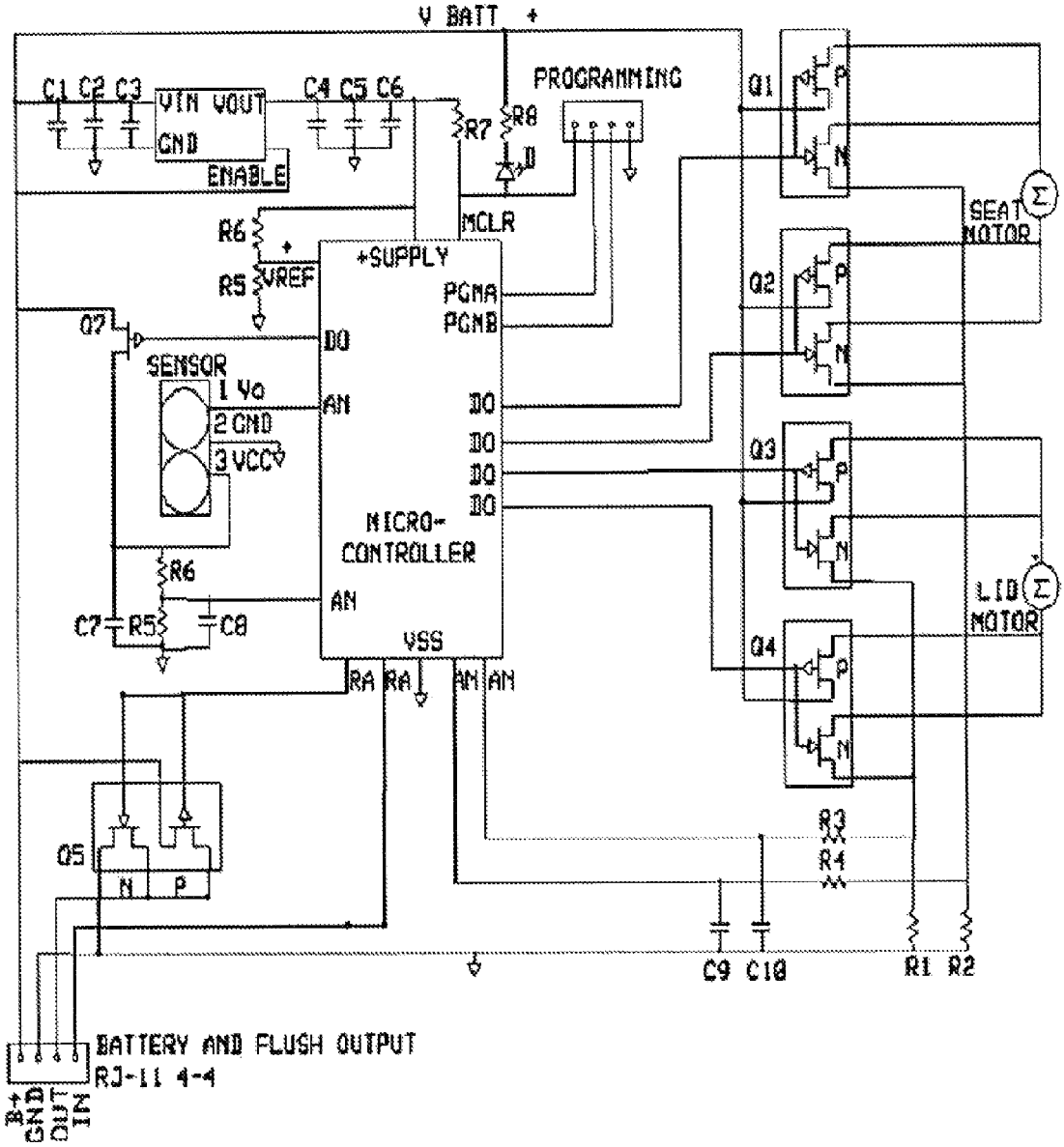
FIG. 9 outlines an embodiment of the control circuit schematic diagram.

FIG. 9 depicts a schematic of the control circuit of one embodiment of the present invention. The control circuit 48, shown in FIG. 3, can be programmed to actuate the motors 40R and 40L in response to signals received from the sensor element 46. One embodiment of the control circuit 48 is shown in FIG. 9. As shown, the control circuit incorporates a microcontroller, related software, two independent motor control H bridges, a motor current sense, a low battery sense, and an FET flush driver voltage regulation and other components. In general, sensor data is sent to the control circuit 48, which monitors sensor readings, and qualifies and enables motor drive transistors to power up and down motion based upon sequence of events and target position. Although an analog sensor is depicted in the schematic, a digital output sensor is also suitable.

One embodiment of the microcontroller program, controls the motor assembly H bridge motor control and flush motor 28, FET control and LED indicator. In this embodiment, the system includes the FET control and flush motor such that the assembly can be programmed to operate an automatic flush as well as the automatic seat and lid. The flush motor 28 can be powered with the same battery 26 as the seat and lid drives. In another embodiment, the flush motor and FET control are not included or may be unattached from the seat and lid assembly. Typically, motor current is measured during lid and seat motion. When the current ascends at the end of travel stop 86 during stall the H-bridge transistors are de-energized and the motor and current ceases. This current monitoring technique requires no limit switches inside the actuator.

In the operation of this embodiment, the toilet lid automatically opens when the control circuit 48 detects that person is closer than the customer set distance. This distance has a default setting, but may be initially re-set and recorded by placing a hand over the sensor window 22 during initial application of power and standing in the desired new set-point position. Typical lid 30 activation distances vary for each installation and can range from approximately 20 to 31 inches. This range may be varied from application to application, if desired. By setting an initial minimum distance for each particular installation, a user can avoid unintentional activation of the assembly. At roughly the same time, the system checks to determine whether the user's hand is located within the trigger distance. If so, the lid 30 and seat 32 are both raised simultaneously. If not, just the lid 30 is raised at this stage. As noted above, the system uses current draw to determine when to stop the motors. After the motor(s) have been operating for a period of time (enough time to allow the voltage/current surge associated with initial start-up to dissipate), the system determines battery voltage. A system variable may be used to store the desired delay before determining battery voltage. If the battery voltage is low, the system periodically flashes a battery low indicator, such as an led. The current draw characteristics of the motor(s) will vary with the battery voltage. Accordingly, the system uses the battery voltage to determine the maximum current value. In the described embodiment, the maximum current value is drawn from a look-up table stored in memory, with the battery voltage being used as the index to the look-up table. In some applications, it may be appropriate to use a fixed maximum current value or to use a formula to determine the maximum current value, for example, using battery voltage as a variable in the formula. The system will continue to monitor the battery current as the motor(s) continue to operate. Once the current drawn by a particular motor exceeds the maximum current, the system stops that motor.

In situations where the user does not raise the seat 32 at the same time as the lid 30, the user has another opportunity to direct the system to raise the seat 32 after the lid 30 has been raised. In the described embodiment, the system does not monitor for a seat 32 activation signal from the user while the lid 30 is being raised because the motion of the raising lid 30 in front of the sensor may provide a false seat trigger. Following the raising of the lid, if the user desires to additionally raise the seat, a simple hand wave in front of the sensor window 22 will activate the seat 32. A closer distance set point may be programmed for this additional seat 32 activation to prevent a standing torso from falsely triggering the seat 32 when not required. Upon opening the lid 30, a time period limit is implemented to allow seat 32 activation (e.g. 2-10 seconds). After the time period, seat 32 activation is disabled to prevent a person from triggering the seat 32 while seated on the toilet during use. After the sensor assembly 38 detects that user has left (e.g. the user moves outside the trigger distance), the system closes the lid 30 and seat 32 (if required). A time delay may be implemented before closing the lid 30 and seat 32 (if required). In the embodiment including a flush motor 28, after closing is complete the flush motor 28 is activated and system is reset.

In one embodiment, the consumer has the option to change the default set distance point and reprogram the internal operational logic during the initial power up sequence. One logical operation allows the lid to rise when a torso is detected and the seat to rise with a hand motion as described above. In an alternate logical operation, both the lid and seat are programmed to rise together with the detection of a person's torso, and the seat to subsequently lower with a hand signal or another signal. This alternate logic assures a clean seat in a public facility for predominantly male usage. Reprogramming the logical operation may be accomplished by placing a hand over the sensor window 22 for 5 seconds during initial application of power. The closer distance is identified and will toggle logical operation change or select among other software features found in the alternative embodiments. In additional alternative embodiments, the control circuit 48 may be connected to additional elements and may output and input additional signals to those elements, such as a night-light, a deodorizer release, a bidet, a heated seat, a timed flush, a courtesy flush, and water saving logic.

The above description is that of the current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. An automatic toilet seat and lid assembly comprising:

a first motor;

a first output shaft, said first output shaft connected to one of the seat and the lid and capable of being actuated to raise and lower said one of said seat and said lid; and a first clutch connecting said first motor to said first output shaft, said first clutch including a first element defining a notch, a second element interfitting with said notch, and a spring biasing said second element into said notch, said second element capable of being forced out of said notch to disengage said first motor from said first output shaft when said one of said seat and said lid are manually raised or lowered, wherein said first element is a wheel in driving engagement with said motor, said wheel including a face perpendicular to the axis of said wheel, said notch defined in said face, wherein said second element is a pin, extending outwardly from said first output shaft.

2. The automatic toilet seat and lid assembly of claim 1 wherein said pin has a circular cross-section including a diameter, and said notch includes a depth that is less than one-half the diameter of said pin.

3. The automatic toilet seat and lid assembly of claim 2 including a stationary housing, and a torsion spring, a portion of said torsion spring connected to said stationary housing, a portion of said torsion spring connected to said first output shaft.

4. The automatic toilet seat and lid assembly of claim 2 including a sensor element, said sensor element capable of receiving a signal, said sensor element actuating said first motor upon receiving said signal.

5. The automatic toilet seat and lid assembly of claim 1 including a second motor, a second output shaft connected to the other of the seat and the lid and capable of raising and lowering the other of the seat and the lid, and a second clutch connecting said second motor to said second output shaft, said second clutch including a first element defining a notch, a second element interfitting with said notch, and a spring biasing said second element into said notch, said second element capable of being forced out of said notch to disengage said first motor from said first output shaft when said one of said seat and said lid are manually raised or lowered.

6. The automatic toilet seat and lid assembly of claim 1 wherein:

one of the seat and said the lid is removably connected to said first output shaft and a housing, the one of the seat and the lid being movable between a lowered position and a raised position and including a first connector connected to said first output shaft and a second connector connected to said housing, said second connector interfitting with said housing such that said connector is locked on said housing in said lowered position and readily removable from said housing in said raised position.

7. The automatic toilet assembly of claim 6 wherein said first motor and said second motor are housed within said housing, said first output shaft extending out of a first side of said housing, said second output shaft extending out of a second side of said housing opposite said first side.

8. The automatic toilet assembly of claim 6 wherein said first connector is a receptacle, said first output shaft extending into said receptacle, wherein said housing includes a post with opposing flat surfaces, and wherein said second connector is a C-shaped flange.

* * * * *

UNITED STATES PATENT AND TRADEMARK OFFICE

CERTIFICATE OF CORRECTION

PATENT NO. : 7,788,741 B2
APPLICATION NO. : 11/357528
DATED : September 7, 2010
INVENTOR(S) : Kurt L. Lohss It is certified that error appears in the above-identified patent and that said Letters Patent is hereby corrected as shown below:

Column 8, Claim 6, Line 16:
delete "said"

Signed and Sealed this

Thirtieth Day of November, 2010

David J. Kappos

David J. Kappos
*Director of the United States Patent and Trademark Office*